United States Patent [19]

Sheppard

[11] 3,952,756

[45] Apr. 27, 1976

[54] SEMI AUTOMATIC PARTS CLEANING MACHINE

[75] Inventor: Richard H. Sheppard, Rancho Palos Verdes, Calif.

[73] Assignee: Purex Corporation, Lakewood, Calif.

[22] Filed: June 14, 1974

[21] Appl. No.: 479,203

[52] U.S. Cl. ..... 134/133; 134/142; 134/159; 134/193

[51] Int. Cl.[2] ..... B08B 3/04

[58] Field of Search ..... 134/133, 134, 142, 159, 134/193, 78, 79, 157

[56] References Cited

UNITED STATES PATENTS

| | | | |
|---|---|---|---|
| 2,818,044 | 12/1957 | Booty, Jr. et al. | 134/159 X |
| 2,830,605 | 4/1958 | Kleeman et al. | 134/159 X |
| 2,990,302 | 6/1961 | Bland | 134/193 X |
| 3,019,800 | 2/1962 | Rand | 134/79 |
| 3,086,538 | 4/1963 | Voltz | 134/193 UX |
| 3,096,774 | 7/1963 | Rand | 134/142 X |

FOREIGN PATENTS OR APPLICATIONS

| | | | |
|---|---|---|---|
| 8,987 | 4/1956 | Germany | 134/134 |
| 152,155 | 6/1904 | Germany | 134/159 |
| 627,908 | 10/1927 | France | 134/159 |

*Primary Examiner*—Robert L. Bleutge
*Attorney, Agent, or Firm*—White and Haefliger

[57] ABSTRACT

Equipment for cleaning metal or plastic parts by immersion in a tank-contained agitated liquid cleaning solution in which the parts are loaded into open side cages mounted on a powered carrier wheel immersed in the solution and having interrupted rotation to carry the parts from a loading station at one side of the carrier above the solution downwardly therethrough and upwardly to an unloading station at the opposite side of the carrier, the tops of the cages being slotted to accommodate mechanical displacement of the parts through the cages and the tank containing stationary barriers blocking movement of the parts through the open sides of the immersed cages.

3 Claims, 4 Drawing Figures

SEMI AUTOMATIC PARTS CLEANING MACHINE

BACKGROUND OF THE INVENTION

In many industrial machine and equipment manufacturing industries it is customary practice to subject parts, typically castings, to successive machining operations at different stages and to clean the work pieces to free them of gross cuttings, oils, chips and shop soils. Such cleaning is usually accomplished in a central or local station by spray washing or by immersion in agitated cleaning solutions such as contained in the tank of the widely used equipment manufactured by the Turco Products Division of Purex Corporation under its trademark "Turbulator" and to which reference hereinafter will be made as suitable, though typical, equipment for cleaning the work pieces. Normally the latter require removal from each or selected machining stages to the central or local cleaning station, and return to the next machining stage.

This general method may result not only in delays for the required parts handling and cleaning but also from interruptions in the parts movement between the machining stages and their ready availability at those stages. Such conventional systems would be subject to improvement by providing at each or intermediate selected machining stages equipment operable to clean and return cleaned parts to the work piece progression at shortened intervals, ideally to the extent of more immediate availability of the cleaned parts to the machine operators.

SUMMARY OF THE INVENTION

The invention has for its general object to provide such cleaning equipment at multiple or individual stages of the parts machining operations so as to economize the total parts cleaning operation by significantly reducing the overall required cleaning time and reducing the manual labor required. In this context the invention contemplates the provision at selected machining stages of interim cleaning equipment employing a succession of cleaning units of the Turbulator type each supplemented by parts containers on carriers operable to immerse the parts in cleaning solutions for controllable time intervals and to return the parts to unloading stations above the cleaning solution for reworking or transference to a successive maching stage. Parts rotation by the carrier is often desirable to insure satisfactory chip removal in minimum time without manual assistance.

More specifically the invention has for its further object to provide cleaning equipment at each stage comprising parts containers as cages having open formation mounted on a revolving, preferably wheel-like, carrier contained in an agitator tank and controllably driven to immerse and invert the parts in the cleaning solution, the carrier drive being controllable to arrest its rotation for prolonged exposure of the parts to the agitated cleaning solution.

A further object is to render the cleaning equipment at least semiautomatic by providing mechanical means operable in timed relation to the carrier drive to load and unload the cages following their elevation out of the cleaning solution.

In more particular detail the invention contemplates the use of parts containers as cages having slotted tops to accommodate power driven pushers for entry to the cages to displace the parts from a loading station through the cages to an unloading station, and the further provision of stationary means within the tank for blocking movement of the parts out of the cage open sides during their cycle through the cleaning solution.

These and additional festures, objects and details of the invention will be more fully understood from the following description of the accompanying drawings.

DESCRIPTION OF A TYPICAL EMBODIMENT

As will be understood from the foregoing and without necessity for further illustration the unit now to be described may be used singly or in multiples along the course of the parts being machined. The parts for cleaning may be assumed typically to be castings diagrammatically indicated at 10 movable in the direction of the arrows on a ball or other type conveyor 11 to a loading station, generally indicated at 12, from which the parts are displaced through carrier-mounted cages to unloading station 13 as will appear.

Figure 1:
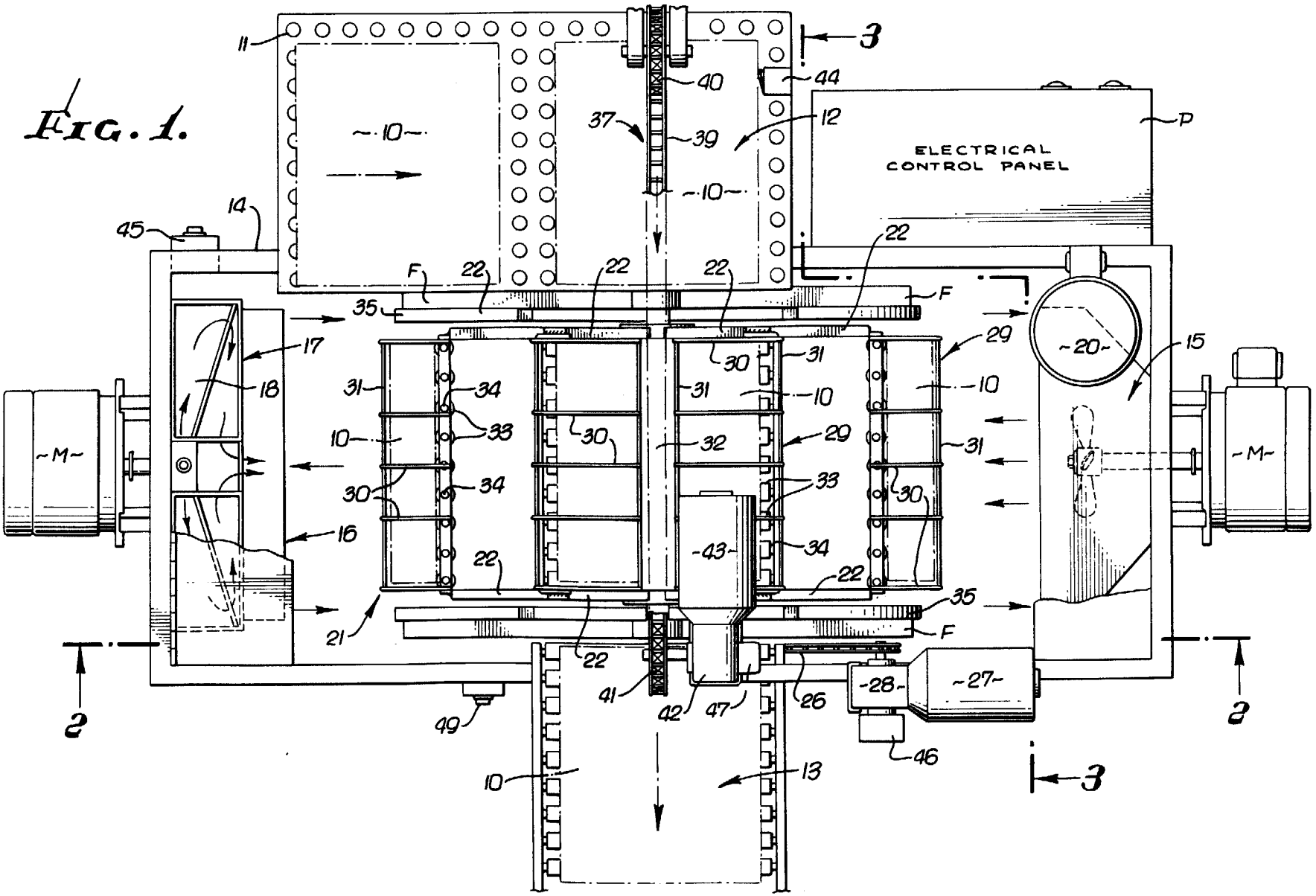
FIG. 1 is a plan view showing the cleaning equipment and associated parts conveyors.

The parts undergo cleaning and inversion in an agitated solution contained in tank 14 to the level L, the tank components being typically of the aforementioned Turbulator type including motor M driven agitator units 15 and 16 operating reversably to produce agitated displacement of the tank solution as indicated by the arrows, or reversably. Included in the agitator system and appurtenant to unit 16 may be a separator 17 through which the liquid is displaced as indicated in FIG. 1 and which includes a chamber 18 for the removal of gross sludge solids and chips from the solution. Optionally the Turbulator system may include also a suction inlet 19 and pump 20 for transference of the cleaning solution to a central filtering location for fine filtering. Being positioned at opposite sides of the tank and cage carrier the units 15 and 16 operate constantly to displace the tank solution in cleaning contact with the carrier immersed parts 10. The direction of displacement of the tank solution may be changed by manual or automatic reversal of the motors M.

Figure 2:
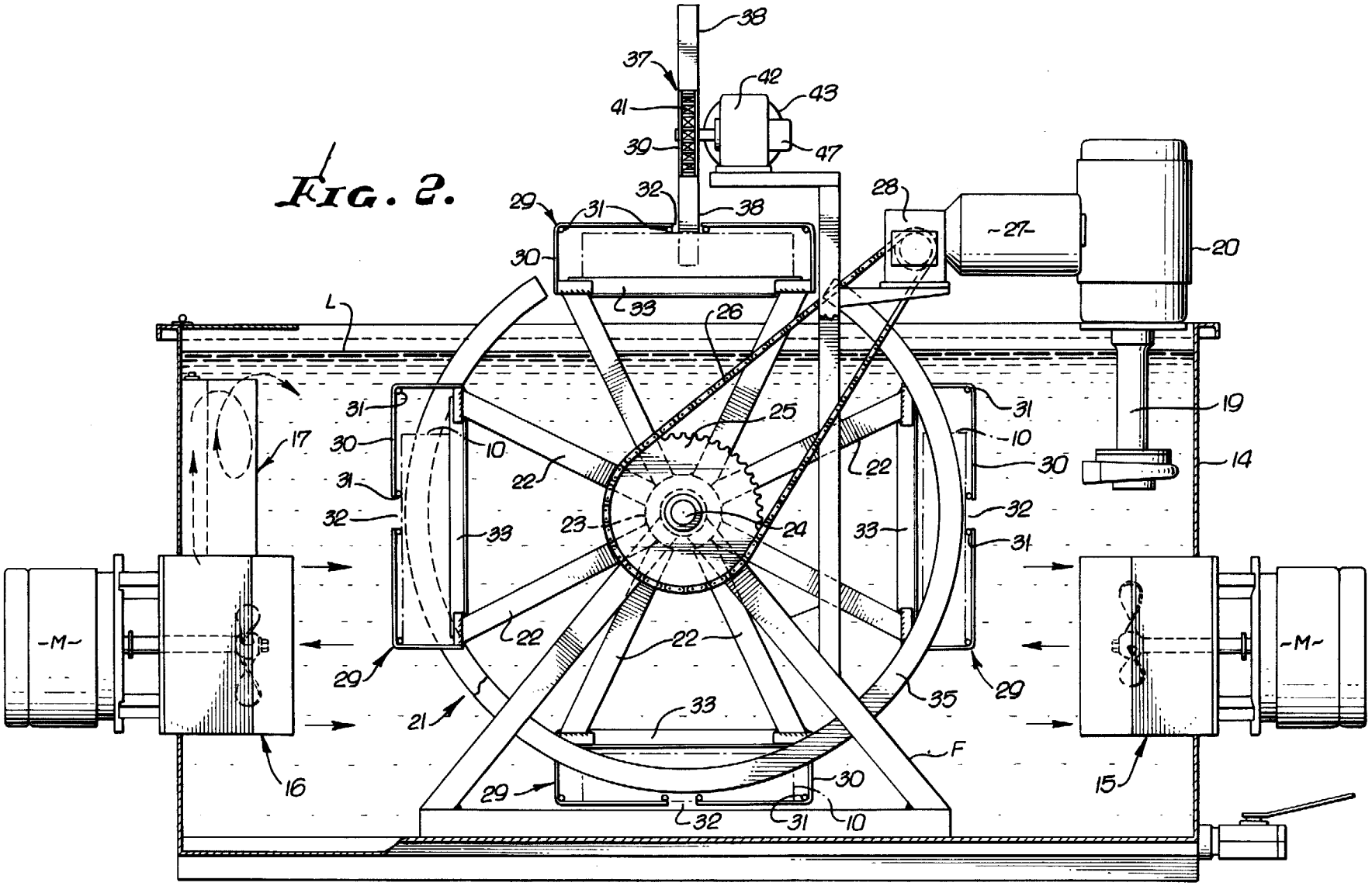
FIG. 2 is a sectional view taken in the vertical plane of line 2—2 in FIG. 1 showing the carrier wheel in side elevation.

Referring particularly to FIG. 2 the tank-contained parts carrier generally indicated at 21 and of wheel-like configuration is shown to be mounted on a suitable frame structure F which, along with the carrier, preferably is so accommodated in the tank as to be removable therefrom. The wheel comprises supporting arms 22 extending radially from the wheel hub 23 mounted for rotation on shaft 24. Sprocket 25 keyed to the hub is driven by chain 26 powered by motor 27 which drives the chain through sprocketed reduction gear 28.

Parts-containing cages generally indicated at 29 are mounted to arms 22 as illustrated, the cages being of open formation defined by wires 30, 31 and having open sides for passage of the parts 10 from the loading station 12 to unloading station 13 as will appear. For cleaning parts smaller than the assumed relatively large size castings 10 the cage walls may be defined by less open material such as wire mesh capable of passing the agitated cleaning solution to the parts but sufficiently restricted as to contain them. Using typically a loading and unloading mechanism as later described, the outer sides of the cages are slotted continuously through them as indicated at 32 to accommodate a driven pusher series. The bottoms or inner sides of the cages are provided with conveyor rollers 33 rotatable about shafts 34.

The invention provides suitable stationary means in the tank for blocking movement of the parts 10 out of the open sides of the cages during passage of the parts through the cleaning solution. Such means is shown to comprise arcuate stationary barriers 35 positioned proximate the open sides of the cages and extending circularly within the tank between the loading and unloading stations.

Figures 3, 4:
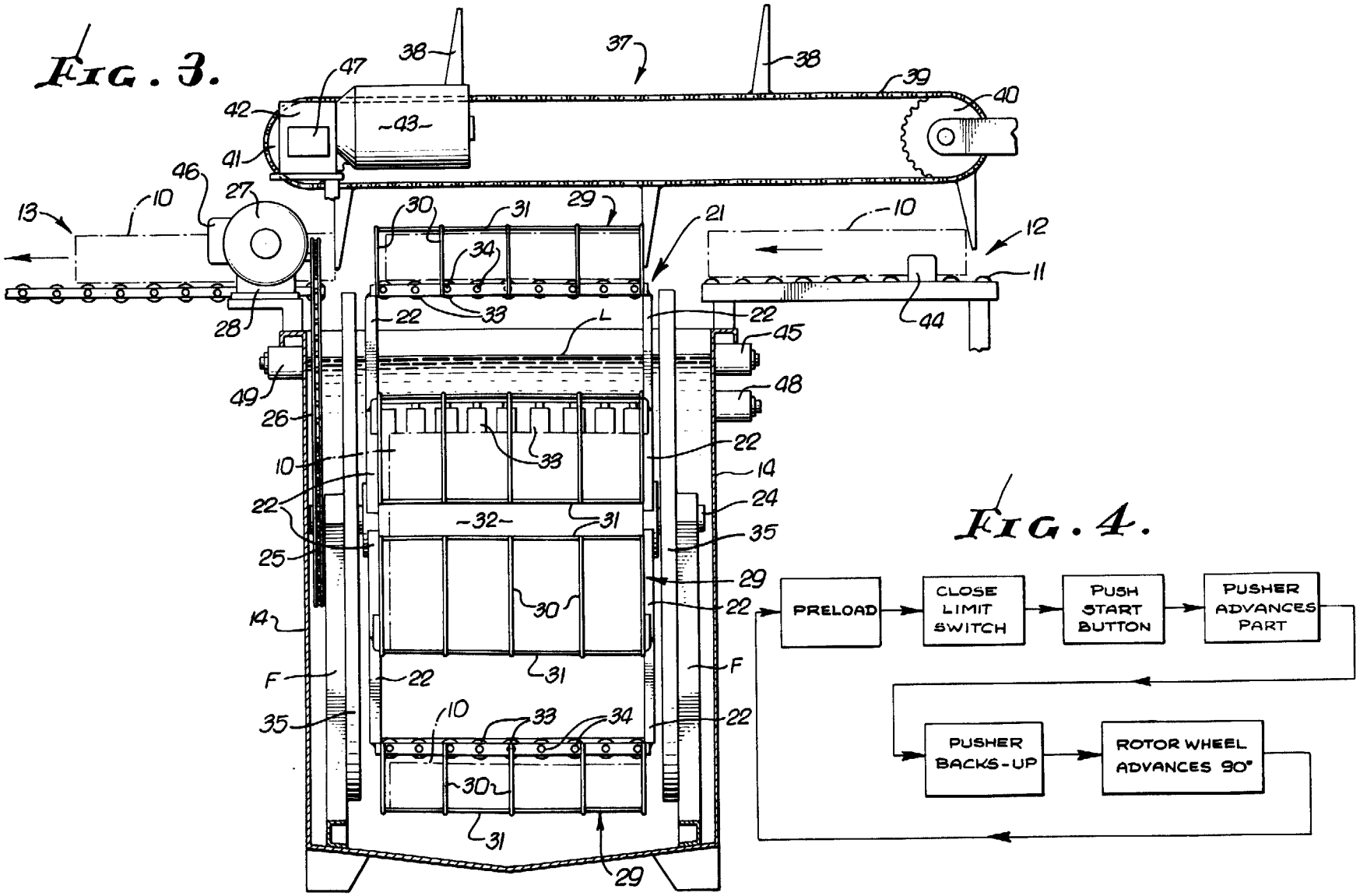
FIG. 3 is a vertical section taken on line 3—3 of FIG. 1.
FIG. 4 is a diagrammatic showing of the operating sequences.

The loading-unloading mechanism generally indicated at 37, see FIG. 3, is shown to comprise a series of uniformly spaced pushers 38 carried by chain 39 to advance about idler sprocket 40 and sprocket 41 of speed reducer 42 driven by motor 43. As illustrated, the pushers 38 are positioned to centrally overlie the cages 29 in the path of the parts being advanced from the loading station to the unloading station.

The carrier rotation performs a particularly useful function by inverting the cages and their contained castings within the cleaning solution to allow cuttings, chips or the like to drop or otherwise separate from the castings as by the washing and entrainment action of the agitated solution. As to the cages, they may be provided in numbers other than the four typically shown and may be movably or relatively stationarily mounted to the carrier as best suits the cleaning problems and conditions. Such conditions may also dictate rotation of the carrier for greater or lesser than 90 degree intervals with corresponding variabilities in the arrest intervals.

In considering the operation of the system assume the part 10 to be pushed manually at the load position shown in FIG. 1 far enough for the part to close switch 44 indicating that the part is in correct position at load. Next, switch 45 is manually pushed to start the machine cycle. In response, motor 43 is started to drive the pusher series for a distance predetermined by limit switch 47. The electric control panel P may contain controls and wiring to automatically start motor 27 and rotation of the cage carrier 21 when a pusher has completed its travel as indicated by limit switch 47. Also the panel controls may permit automatic cycling once the cycle is initiated manually, and panel controls and limit switches may be electrically interlocked to prevent maloperation.

It will be observed that the cages 29 are mounted to the carrier wheel at 90° or quadrant intervals and the operation of the limit switch 46 is such as to control the carrier rotation to maintain each part 10 in the cleaning solution for a predetermined period, e.g., 60 seconds, and to arrest each incremental rotation when the cages arrive at the loading-unloading stations. Simultaneously with the arrested carrier rotation, motor 43 under control of manual switch 45 advances the part 10 from the loading station 12 into contact with the cage-contained cleaned part to push the latter through its cage onto the unloading station 13, the pusher having advanced through the cage slot 32. Limit switch 47 then arrests the pusher movement and the described cycle is automatically repeated. Switch 48 may be provided to permit manual load cleaning and switch 49 may be used as an emergency stop.

If for any reason desired, provision may be made as by motor reversal in the operating sequence depicted in FIG. 4 for back-up movement of the pushers, particularly in the FIG. 3 position.

It will be understood that the drawings are illustrative only of a typical and preferred embodiment of the invention and that various changes and modifications may be made without departure from its intended spirit and scope.

I claim:

1. Apparatus operable to clean parts by movement through a tank-contained liquid cleaning solution, comprising a. a revolving carrier immersed in the solution and having a transverse axis of rotation, b. parts receiving cages each permeable by the cleaning solution and mounted on said carrier to travel through the agitated solution to a parts loading and unloading position above the liquid, c. said cages having open sides through which the parts are loaded and unloaded along a transverse path from one side to the opposite side of the carrier, d. stationary means in the tank operable to block movement of the immersed parts out of the open sides of the cages, said means comprising arcuate barriers extending at opposite sides of the cages substantially throughout the parts movement through the tank solution, e. each cage defining a transverse slot at its radially outer side, and f. there being a series of pushers carried by and spaced along an endless power driven element to move in succession and transversely through successive of the cage slots to displace the parts into and out of the cages through the open sides thereof, at said parts loading and unloading position.

2. Apparatus according to claim 1 in which said cages are mounted to the wheel at quadrant intervals and the wheel rotation is arrested at those intervals.

3. Apparatus according to claim 1 wherein said element comprises a chain extending transversely above said position, said pushers movable in alignment with said transverse path.

* * * * *